US007866507B2

(12) United States Patent
Sawin et al.

(10) Patent No.: US 7,866,507 B2
(45) Date of Patent: Jan. 11, 2011

(54) CLEANING WIPE CONTAINER INCLUDING A TRANSFERABLE LABEL

(75) Inventors: Philip Andrew Sawin, Wyoming, OH (US); Jeffrey Alan Sargent, West Chester, OH (US); Kilian John O'Neill, Falkenstein (DE)

(73) Assignee: The Procter & Gamble Company, Cincinnati, OH (US)

( * ) Notice: Subject to any disclaimer, the term of this patent is extended or adjusted under 35 U.S.C. 154(b) by 622 days.

(21) Appl. No.: 11/724,022

(22) Filed: Mar. 14, 2007

(65) Prior Publication Data

US 2008/0223868 A1 Sep. 18, 2008

(51) Int. Cl.

| | |
|---|---|
| ***B67B 7/00*** | (2006.01) |
| ***G01F 11/00*** | (2006.01) |
| ***B65D 73/00*** | (2006.01) |
| ***A47K 10/24*** | (2006.01) |
| ***B65H 1/00*** | (2006.01) |

(52) U.S. Cl. ..... 222/1; 222/146.6; 222/105; 206/469; 206/494; 206/459; 206/232; 206/216; 206/459.6; 221/46; 221/63

(58) Field of Classification Search ..... 221/46, 221/63; 434/258; 700/215, 216, 231; 40/310, 40/306; 283/81, 67; 383/9; 206/469, 459, 206/494, 232, 216, 459.6; 191/78; 155/50; 159/249; 222/146.6, 1, 105

See application file for complete search history.

(56) References Cited

U.S. PATENT DOCUMENTS

| | | | | |
|---|---|---|---|---|
| 4,543,139 | A | 9/1985 | Freedman et al. | |
| 4,598,528 | A * | 7/1986 | McFarland et al. | 53/430 |
| 4,789,058 | A * | 12/1988 | Blaney | 206/232 |
| 4,790,436 | A * | 12/1988 | Nakamura | 206/449 |
| 4,863,064 | A | 9/1989 | Dailey, III | |
| 5,050,737 | A * | 9/1991 | Joslyn et al. | 206/494 |
| 5,515,972 | A * | 5/1996 | Shames | 206/425 |
| 5,992,073 | A * | 11/1999 | Wolpa | 40/651 |
| RE37,164 | E * | 5/2001 | Petrou | 156/249 |
| 6,454,095 | B1 * | 9/2002 | Brisebois et al. | 206/494 |
| 6,502,986 | B1 | 1/2003 | Bensur et al. | |

(Continued)

FOREIGN PATENT DOCUMENTS

| | | |
|---|---|---|
| AU | 513 140 B3 | 4/1981 |

(Continued)

OTHER PUBLICATIONS

U.S. Appl. No. 11/544,318, filed Oct. 6, 2006, Sawin et al.

(Continued)

*Primary Examiner*—Gene O. Crawford
*Assistant Examiner*—Rakesh Kumar
(74) *Attorney, Agent, or Firm*—John G. Powell

(57) ABSTRACT

A cleaning wipes container having one or more panels and a lid that covers an opening. The opening provides access to an interior storage space defined by the one or more panels. The interior storage space is configured to receive a wipes cartridge. The container also has a viewing area on at least a portion of one panel. The viewing area provides a target surface to join a transferable label. The transferable label includes indicia that relate to a characteristic of a type of cleaning wipes in the wipes cartridge. The indicia are viewable from outside the container.

12 Claims, 5 Drawing Sheets

U.S. PATENT DOCUMENTS

| | | | | |
|---|---|---|---|---|
| 6,520,543 | B1 * | 2/2003 | Hoar | 283/67 |
| 6,554,134 | B1 | 4/2003 | Guibert | |
| 6,594,927 | B2 * | 7/2003 | Witkowski | 40/310 |
| 6,698,928 | B2 | 3/2004 | Miller | |
| 6,767,604 | B2 | 7/2004 | Muir, Jr. et al. | |
| 6,926,173 | B1 * | 8/2005 | McGlothlin et al. | 222/183 |
| 7,303,092 | B2 * | 12/2007 | Sarbo et al. | 221/46 |
| 7,571,809 | B2 * | 8/2009 | Yahiel | 206/459.5 |
| 2003/0217489 | A1 * | 11/2003 | Witkowski | 40/306 |
| 2006/0186131 | A1 | 8/2006 | Panning | |
| 2007/0130709 | A1 * | 6/2007 | Cohen et al. | 15/105 |
| 2007/0144929 | A1 * | 6/2007 | Minerath et al. | 206/459.5 |
| 2008/0017750 | A1 * | 1/2008 | Sellars et al. | 242/597.7 |
| 2008/0061073 | A1 * | 3/2008 | Laroche | 221/46 |
| 2009/0071862 | A2 * | 3/2009 | Snell | 206/524.8 |
| 2009/0078721 | A1 * | 3/2009 | Hoffman et al. | 222/1 |

FOREIGN PATENT DOCUMENTS

| | | | |
|---|---|---|---|
| EP | 0 744 357 | B1 | 10/2000 |
| WO | WO 99/06311 | A | 2/1993 |
| WO | WO 93/17933 | A | 9/1993 |
| WO | WO 2006/071279 | A | 7/2006 |

OTHER PUBLICATIONS

U.S. Appl. No. 11/724,083, filed Mar. 14, 2007, Sawin et al.
International Search Report, dated Aug. 28, 2008 (4 pages).
International Search Report, dated Dec. 29, 2008, 6 pages.
International Search Report, dated Oct. 4, 2007, 4 pages.

* cited by examiner

CLEANING WIPE CONTAINER INCLUDING A TRANSFERABLE LABEL

FIELD OF THE INVENTION

The present disclosure generally relates to product dispensers that store and dispense cleaning wipes and, more particularly, to product dispensers that display indicia related to the cleaning wipes housed in a cartridge disposed in the container.

BACKGROUND OF THE INVENTION

Cleaning wipes generally are sold in plastic tubs, tubes or other containers, and a user typically extracts a wipe for use by pulling the wipe through an opening in the container. Preferably, the opening is covered by a lid. Commonly, the plastic container or tub is sold pre-loaded with a supply of wipes. Once a consumer depletes the original supply of wipes, the user may discard the empty container and purchase a new pre-loaded container or tub. Of course, discarding the empty containers and purchasing new containers just to get a new supply of wipes tends to waste a considerable amount of material, especially plastic. Further, retailers must set aside a great deal of shelf space in order to stock enough pre-loaded containers or tubs to meet demand.

To address some of these problems, manufacturers have recently introduced products that reuse the original wipes container. Instead of stocking exclusively pre-loaded containers or tubs, retailers now can stock a supply of pre-loaded containers, along with a supply of refill cartridges. Typically, these refill cartridges are made out of a lower cost packaging material. Often the refill cartridge package will be smaller than the pre-loaded container package. Consequently, retailers can stock many more refill cartridges than pre-loaded containers for a given shelf space, thus making better use of the available retail space. Also, because the cleaning wipes are substantially uniform in size and shape across different manufacturers, most refill cartridges made by one manufacturer can be used with the containers or tubs of other manufacturers.

Furthermore, because of widely differing consumer tastes, manufacturers tend to make a wide variety of cleaning wipes. For example, some consumers desire scented wipes, while other consumers demand wipes that are free of all dyes, scents, or perfumes. Still other consumers desire wipes having lotions, such as aloe vera, lanolin, or other materials, often with or without the addition of alcohol. Still other consumers want gentle wipes, or wipes free of any lotion, alcohol, or other additives. However, because the wipes within the container typically cannot be identified without a label, the exterior of the container usually includes some sort of permanent label or indicia identifying the type of wipes in the container. Thus, it is possible for a consumer to mismatch the type of wipe in a refill cartridge with the type of label on the container, resulting in a situation where a consumer may not know what type of wipe is in the container.

Accordingly, it would be desirable to provide a cleaning wipe container that allows a user to change the label on the container in order to indicate the correct type of wipe being stored or dispensed by the container.

SUMMARY OF THE INVENTION

In order to provide a solution to the inconveniences set forth above, one embodiment of the present invention provides a re-useable cleaning wipe container comprising an interior storage space defined by a bottom panel, a top panel and one or more side panels. The container includes a lid covering an opening. The opening provides access to the interior storage space. The interior storage space is configured to receive a wipes cartridge. The container also has a viewing area on at least a portion of one panel. The viewing area provides a target surface to join a transferable label. The cleaning wipe container additionally includes a wipes cartridge at least partially disposed in the interior storage space. The wipes cartridge includes a plurality of cleaning wipes. The cleaning wipe container further comprises a transferable label joined to at least a portion of the viewing area. The transferable label includes indicia that relate to a characteristic of a type of cleaning wipes in the wipes cartridge. The indicia are viewable from outside the container.

DETAILED DESCRIPTION OF THE INVENTION

Figure 1:
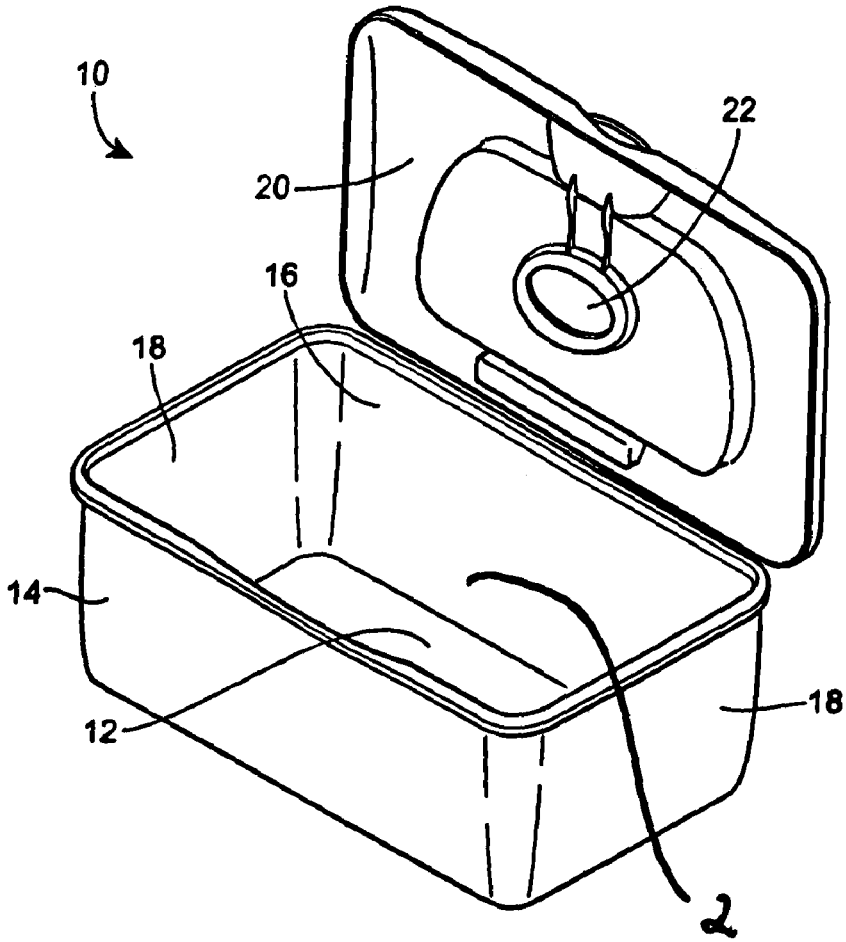
FIG. 1 is a perspective view of a prior art cleaning wipe container with an open lid.

The term "joined" refers herein to the attachment together of two or more components, either by direct affixment of a first element to a second element or by affixment of the first element to an intermediate element which is affixed to the second element.

As used herein, the term "reattachable" refers to the attachment of two or more elements or portions of elements together in a manner in which they can be separated and reattached successively without substantial degradation of fastener performance or damage to surrounding components of the article, which would impair its continued use. It will be appreciated that a reattachable component need not have an infinite life span, but it is sufficient that the reattachable components can be separated and reattached successively at least several times over the typical use life span of the article. It will also be appreciated that the aggressiveness of actual fastening or tack may be reduced significantly from fastening to refastening in absolute terms, but that such reduction is not "substantial degradation" of fastener performance if the resulting refastened strength is sufficient to keep a label substantially joined to a container.

As used herein, the term "non-permanently joined" and "removably joined" are used interchangeably and generally refer to two or more components of an article joined together such that when the components are separated there is little or no damage to the components themselves or the surrounding components, which would impair the use of the article or any component thereof.

As used herein, the term "transferable" generally refers to a removable and/or reattachable element that is intended to be transferred from a first location to a second location. For example, a label that is removably joined to a first package and then removed from the first package and joined to a second package is a transferable label.

As used herein, the term "adhesive" refers to a composition which demonstrates connection when applied to another material or composition generally (e.g. material is not specially selected). Adhesive compositions connect to other materials or compositions generally and no particularly selected properties of the other material or composition are necessary to demonstrate a general tendency to adhere.

As used herein, the term "cohesive" refers to a material which demonstrates surface interaction (in terms of connection of one surface to another) when applied to a specially selected material. An A-A type cohesive material will fasten or form a connection primarily to itself or to similarly structured materials. Generally, such materials are substantially non-tacky (such as to skin) at room temperature even under some pressure. An A-B type cohesive material demonstrates surface interaction properties where material A will stick to different material B. However, A may also attach to A and B may attach to B. An A-B type cohesive system could also exist where type A material may attach to material of type A or type B, but the B type material will not attach to itself or other materials other than A. Materials which are designed to receive (i.e. allow the surface interaction) with a particular cohesive material, but which themselves will not connect with any other materials (or itself) are still considered "cohesive materials" within the meaning of this specification when they act as the target surface for a specific cohesive engaging material.

As used herein, the terms "indicia" and "indicium" are interchangeable, and generally refer to one or more visually detectable cues.

As used herein, the term "viewable" or "visible" are interchangeable and generally refer to an object or indicium that is detectable by the human eye at a distance of about 12 inches.

Figure 2:
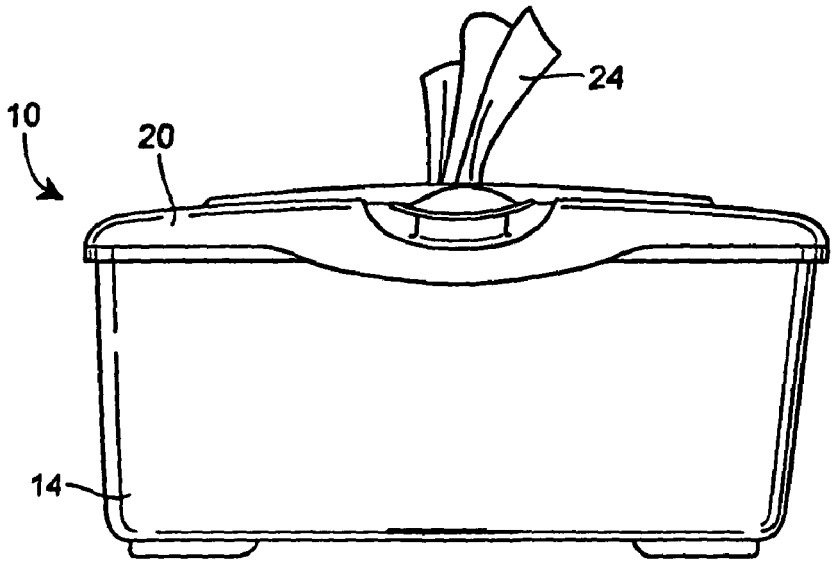
FIG. 2 is a front view of the prior art cleaning wipe container of FIG. 1 with a closed lid and a wipe extending through the lid and ready for use.
Figure 3:
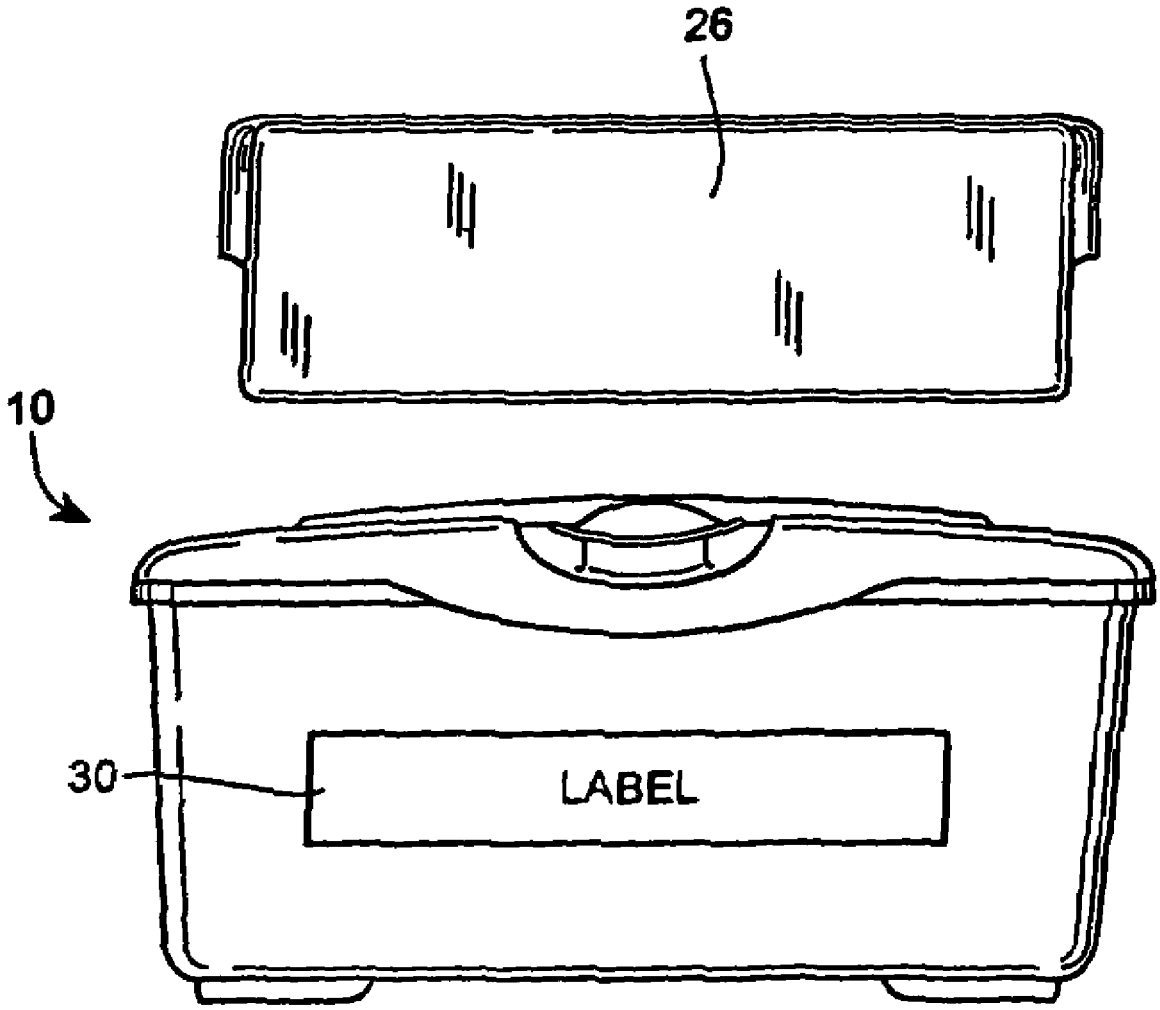
FIG. 3 is a front view of the cleaning wipe container of FIG. 1 and a refill cartridge.

Cleaning wipe containers 10, shown in FIGS. 1-3, may include a bottom panel 12, a front panel 14, a rear panel 16, and a pair of side panels 18. The cleaning wipe containers 10 of FIGS. 1-3 may also include a lid 20 hingedly connected to the rear panel 16. In such a configuration, a storage space 2 may be defined above the bottom panel 12 and between the front, rear and side panels 14, 16, 18. The lid 20 may further include an aperture 22 through which cleaning wipes 24 can be extracted from the container 10 when the lid 20 is closed, as shown in FIG. 2. When a supply of cleaning wipes is depleted within the container 10, the container 10 may be refilled with a cartridge 26 that includes a plurality of cleaning wipes. The container 10 is typically made of an opaque plastic material and may include a label 30 on the front panel 12, as shown in FIG. 3. The label 30 may describe the type of cleaning wipes 24 in the container 10, ingredients used in the cleaning wipes 24 and/or instructions for using the cleaning wipes. The label 30 is typically made of a paper or plastic material that is adhesively attached to the front panel 12. As a result, if a consumer wishes to change the type of wipes being used, it may be necessary to purchase a new container 10 with a new label 30 to reflect the new type of wipes disposed in the container 10.

Figure 4:
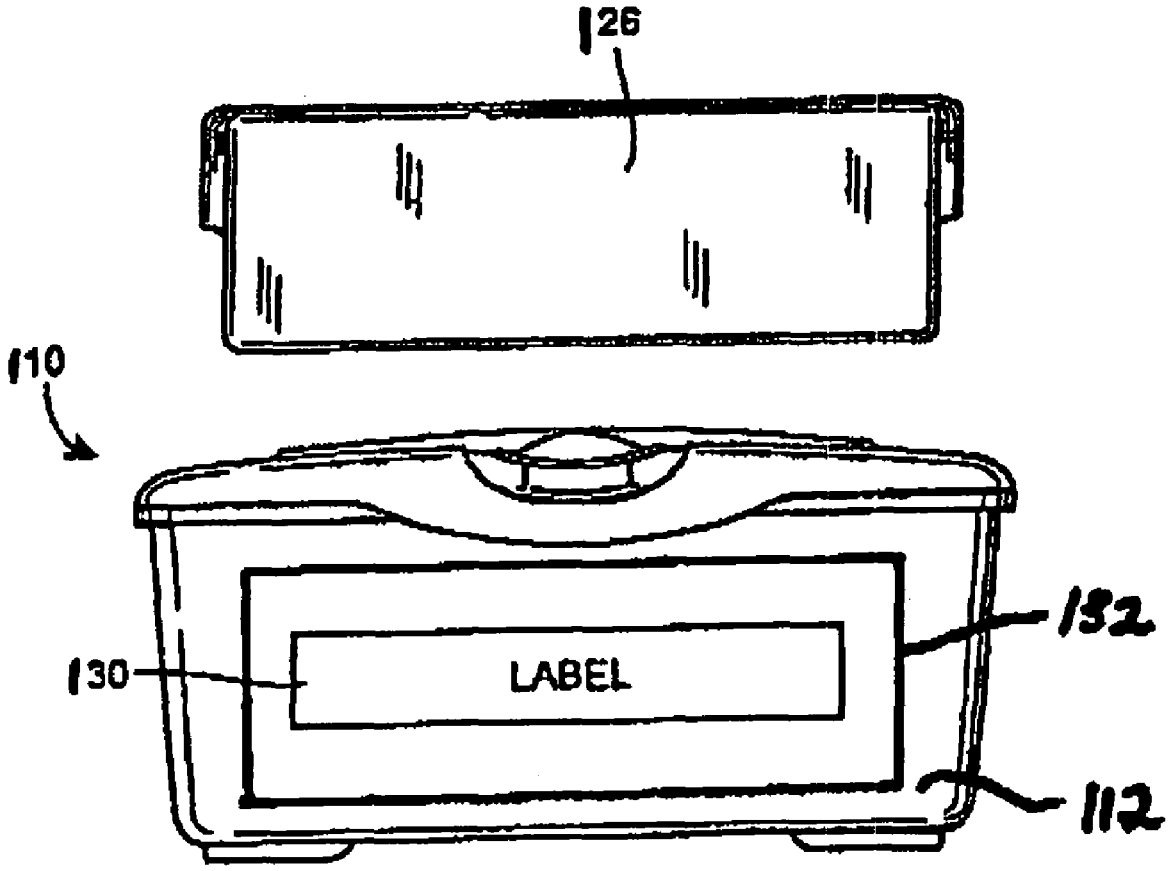
FIG. 4 is a front view of a cleaning wipe container showing a label disposed on a viewing area target surface and a refill cartridge.

FIG. 4 shows a cleaning wipe container 110 and cartridge 126 according to one example of an embodiment of the present invention. The cleaning wipe container 110 has at least a portion of one panel, such as, for example the front panel 112, which includes a viewing area 132 for displaying a label 130. While the viewing area is provided by a portion of the front panel 112 in the present example, is it to be understood that an entire panel, or all panels (or portions thereof) of the container 110 may be suitable for providing one or more viewing areas 132 on which to display a label 130. The viewing area 132 may be configured to provide a target surface for displaying a label 130 such that the label 130 will be viewable from the outside of the container 110 by a target person, such as, for example, a consumer.

In order to provide a target surface for a label 130, the viewing area 132 may include one or more non-permanent fasteners that join the label to the container 110 in the vicinity of the viewing area 132. Having a removably joined label 130 on the container 110 may enable a user to replace the label 130 with a different label 130 when the user purchases a refill cartridge 126 comprising a different type of wipes. By enabling a user to change the label 130, the likelihood that the label 130 will indicate the incorrect type of wipes in the container 110 may be reduced. In addition to being removably attached to the viewing area, the label 130 may be reattachably joined to the viewing area. Some consumers may desire to replace a first type of wipes in the container with a second type of wipes before the first type of wipes are completely consumed. By providing a label 130 that is reattachable, a consumer may remove the label 130 that corresponds to the first type of wipes and replace it with a label 130 that corresponds to a second type of wipes. Subsequently, if the consumer decides to again use the partially consumed first type of wipes, the consumer can simply reattach the label 130 corresponding to the first type of wipes to the viewing area 132. The label 130 may also be transferable. For example, the label 130 may be configured to be removably joined to a first surface or substrate, such as, for example a wipe cartridge or polyolefin film, and then subsequently removed from the first surface or substrate and joined to a second surface, such as, for example a viewing area 132. The label 130 may also include one or more non-permanent fasteners. The fastener(s) included with the label 130 may be the same, substantially the same, complementary to, or different from the fastener(s) of the viewing area 132. The fastener(s) included with the label 130 may be disposed on one or more surfaces of the label 130 or a portion(s) of one or more surfaces of the label 130, or the fastener may be an integral part of the label 130.

One non-limiting example of a complementary fastener includes a magnetic fastener. A magnetic fastener typically requires that at least a portion of two different surfaces are each provided with one or more magnets that will attract each other, such as, for example due to a difference in polarity, with enough force to join the two surfaces together. In one example of an embodiment of the present invention, the viewing area 132 and label 130 are each provided with one or more magnets, such that the magnet(s) of the viewing area 132 will attract the magnet(s) of the label 130, and vice versa. When the label 130 is then brought to within a particular distance of the viewing area 132, an attractive magnetic force will cause the label 130 to become affixed to the container 110 in the vicinity of the viewing area 132. In another example, a portion of the viewing area 132 may include a magnetic material, such as, for example iron. The magnetic material may be added during any step in manufacturing process of the container 110. In such an example, a magnet contained in the label 130 would be attracted to the magnetic material in the viewing area 132 thereby causing the label 130 to become affixed to the container 110 in the vicinity of the viewing area 132. Similarly, a portion of the viewing area 132 may include the magnet while a portion of the label 130 includes a magnetic material. A cleaning wipes container 110 employing magnetic fasteners, such as, for example the magnetic fasteners described above, may allow a user to remove and reattach a label 130, or to remove one label 130 and attach a different label 130 that has the appropriate magnet or magnetic material.

In embodiments wherein the label 130 is a permanent magnet or the equivalent thereof, the magnet may be recycled for other uses upon depletion of the wipes in the container 110. One example of such a use is what is sometimes referred to as a refrigerator magnet. Refrigerator magnets are typically used to join papers and other objects of interest to a surface of a refrigerator. A manufacturer of wipes that provide consumers with a reusable magnetic label, such as the one described above, not only provides the consumer with an added benefit, i.e., providing a new use for an item that was previously discarded, but may also receive additional product marketing when the manufacturer places product information, such as, for example brand names and logos, on the magnet.

Another non-limiting example of a complementary fastener for use with a viewing area 132 and a label 130 includes hook and loop type fasteners. One suitable hook and loop type fastener is marketed under the tradename VELCRO. Hook and loop type fasteners are generally configured such that there is a first surface having a plurality of hook shaped filaments and a second surface, which is to be joined to the first surface, having a plurality of loop shaped filaments. When the hook shaped filaments and the loop shaped filaments are brought into contact or close proximity of one another, the hook and loop shaped filaments may become interlocked or releaseably engaged, thereby enabling the first and second surfaces to become affixed to each other. In the case of the present disclosure, the viewing area 132 may be provided with hooks while the label 132 is provided with loops or vice versa, thereby allowing a user to remove and reattach the label 130, or to remove one label 130 and attach a different label 130 that has the appropriate hook or loop type fastener.

While the above examples may describe magnetic and hook and loop type fasteners, it is to be understood that any suitable fastener known to those of ordinary skill in the art is contemplated by the present invention. Additional non-limiting examples of suitable fasteners include snaps, buttons, adhesives, cohesives, slots, grooves, combinations thereof and the like.

Figure 5:
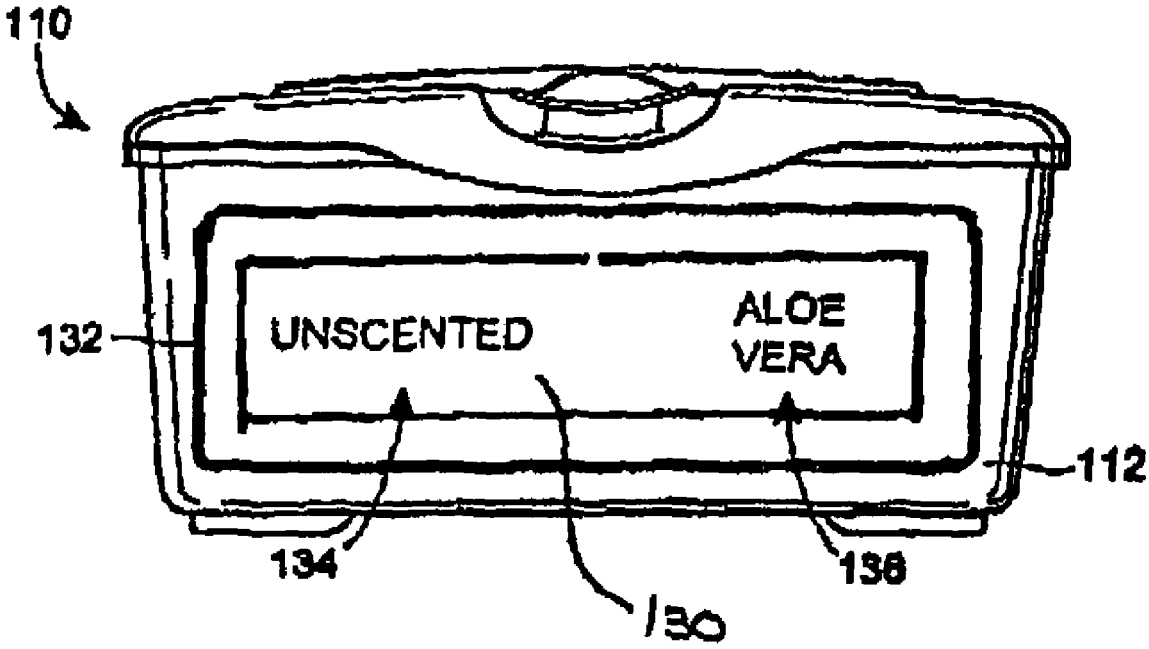
FIG. 5 is a front view of a cleaning wipe container showing a label that includes content-specific messages.

The label 130 according to the present disclosure may include a wide variety of indicia useful for communicating information to a consumer. The label 130 may include indicia that depict one or more content-specific messages, such as the content-specific messages 134, 136 shown in FIG. 5. The one or more content-specific messages 134, 136 may describe a characteristic of the wipes in the cartridge 126. For example, the content-specific messages 134, 136 may describe the type of wipes, the ingredients in the wipes, instructions for using the wipes, and/or the amount of wipes. Alternatively, the label 130 may include more general information related to the wipes or type of wipes disposed in the container 110. For example, the label 130 may include indicia depicting one or more cartoon characters and/or anthropomorphic objects, which a consumer may associate with wipes or a type of wipes. Another example is a label 130 that includes indicia depicting a baby, a background color, and a shape resembling a water drop. In such an example, the indicia, by virtue of a single depiction and/or color or combination of depictions and/or colors may indicate to a user that the wipes are wet wipes and/or that the wipes may be useful for cleaning a baby. Still another example includes a label 130 having the same or substantially the same colors, patterns, or other indicia that are displayed on a particular refill cartridge 126 and/or its packaging.

While the above examples may be generally directed to indicia on the label 130, it is to be understood that embodiments wherein the viewing area and/or one or more panels or panel portions also include indicia that may or may not be related to the indicia on the label 130 or to wipes or a type of wipes are also contemplated by the present invention. For example, the label 130 may include indicia that depict the word "scented" while one or more other portions of the container 110 depict indicia of flowers. Another example includes a label 130 including indicia of a content-specific message of aloe vera, while one or more other portions of the container 110 include indicia depicting a manufacturer brand name. Additionally, while the examples disclosed may only include indicia in the form of printed letters and objects, it is to be understood that the present invention is not limited to such indicia. Other non-limiting forms of indicia include words, numbers, characters, symbols, shapes, colors, patterns, raised portions and/or combinations thereof The cartridge 126 will typically include a plurality of wipes. The cartridge 126 may provide packaging for the plurality of wipes, such as, for example a synthetic polymer film that substantially surrounds the plurality of wipes. Alternatively, the cartridge 126 may be configured as a cardboard or paperboard box with the wipes disposed inside the cartridge 126. However, it is to be understood that the cartridge 126 may be made of any suitable material commonly known in the art. The cartridge 126 may include at least one label 130, which is removably attached to the cartridge 126. The label 130 may be transferable. The label 130 may be joined to the cartridge 126 or the packaging that substantially surrounds the cartridge 126 by any suitable non-permanent attachment means commonly known in the art. In embodiments wherein the label 130 is joined to the packaging that substantially surrounds the cartridge 126, the label 130 may be disposed on the inside of the packaging, between the packaging and the cartridge 126, or the label 130 may be joined to the outside of the packaging. In still other embodiments, the label 130 may be an integral part of the packaging that substantially surrounds the cartridge 126, such as, for example a portion of a polymer film that has weakened areas defining the label 130. Additionally, the label 130 may be joined to the cartridge 126 or the packaging that substantially surrounds the cartridge 126 with fasteners that are the same as, substantially the same as, or complementary to the fastener(s) used to join the label 130 to the viewing area 132, but need not necessarily be so. Alternatively, the label 130 may be included with the cartridge 126 and not joined thereto, such as, for example a label 130 that is placed in a paperboard box in which the cartridge 126 is packaged, but is not joined to either the paperboard box or the cartridge 126. In some embodiments it may be necessary or desirable to provide separate packaging for the label 130 in order to reduce any potential reduction in effectiveness of the label's fastener.

In one particular example, the label 130 may be disposed on the cartridge 126 such that when the label is removed, an opening is formed in the cartridge 126 thereby enabling a user to access wipes contained within the cartridge 126. The label 130 may also be provided with a removable backing material that at least partially covers the fastener on the label 130. Removing the backing material from the label 130 then exposes the fastener such that a user may reattachably join the label 130 to the cleaning wipes container 110. The label 130 may also be configured such that the label 130 is reattachably joined to the cartridge 126. A label 130 that is reattachably joined to the cartridge 126, may provide a means for resealing the wipes cartridge in the event a wipes container is not available thereby preventing evaporation or loss of particular compositions that may be present on or in the wipes. For example, if the wipes contained in the cartridge 126 are of the type that includes a substantial amount of liquid, such as, for example water, and a consumer purchases a refill pack but does not have a wipes container then the consumer can still reseal the refill pack, thereby increasing the likelihood that the wipes will perform as expected and/or desired.

Figure 6:
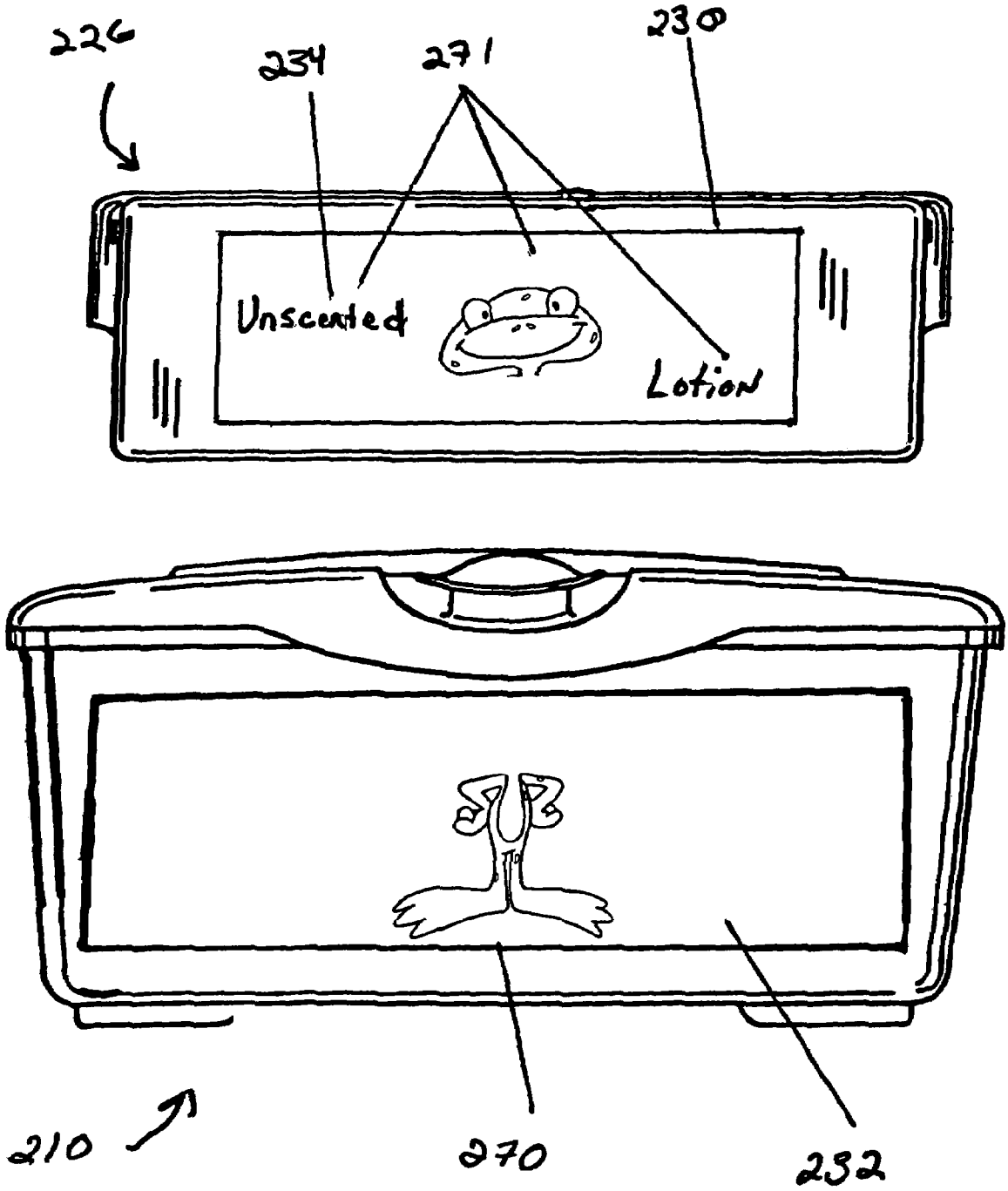
FIG. 6 is a front view of a cleaning wipe container and a refill cartridge with complementary indicia.

FIG. 6 shows a container 210 and a cartridge 226 according to the present invention. The wipes container 210 of FIG. 6 includes indicia 270. The indicia 270 may be disposed on the viewing area, but need not necessarily be so. The indicia 270 may be any incomplete depiction, such as, for example an anthropomorphic object that is missing one or more body parts. The example shown in FIG. 6 is an incomplete depiction of a frog wherein the incomplete portion includes the frog's head. However, it is to be understood that the indicia 270 is not limited to frogs or even anthropomorphic objects, but includes any object that can be rendered as a partial depiction in accordance with the present invention. The container 210 may further include a viewing area 232. The viewing area 232 may be configured to provide a target zone for removably and/or reattachably joining a label 230.

The cartridge 226 includes a transferable label 230 joined to the cartridge 226. The label 230 may adapted to be removably and/or reattachably joined to the container 210 such as, for example by including one or more of the fasteners described above. The transferable label 230 and the viewing area 232 may be configured to enable a user to join the transferable label 230 to the container 210 in a particular portion of the viewing area 232. One nonlimiting example includes providing a viewing area 232 that has one or more dimensions, for example height and length, approximately equal in value to the corresponding dimension(s) of the transferable label 230. Alternatively, the viewing area 232 may include indicia that suggests to a user the particular position in which the transferable label 230 should be placed.

The transferable label 230 may include indicia 271 that are complementary to the indicia 270 on the container 210. Such complementary indicia 271 on the transferable label 230 may provide the incomplete portion of the indicia 270 on the container 210. For example, the indicia 270 on the container 210 may include the anthropomorphic body of a frog having no head, while the indicia 271 on the transferable label 230 include a frog head. The indicia 271 on the transferable label 230 may further include content-specific messages 234, such as, for example the content-specific messages of "unscented" and "lotion." Other suitable examples of content-specific messages 234 include the content-specific messages described hereinabove. While the transferable label 230 may be made of any suitable material known in the art, it may be desirable to select a material that is transparent, such as, for example certain polyolefin films. By providing a transferable label 230 that includes transparent material, the transferable label 230 may be joined to the container 210 such that the indicia 270 on the container and the indicia 271 on the label are viewable simultaneously. It may be desirable to arrange the indicia 271 such that the content-specific messages 234 are interactively displayed with the indicia 270 depicted on the container 210. For example, the content-specific message 234 of "scented" may be displayed on or around the nose of the frog head depicted by the indicia 271 on the transferable label 230 such that when the label is joined to a particular portion of the viewing area 232 it appears the completed depiction of the frog is smelling the word "scented." In another example, the content-specific message 234 may be a word or symbol that communicates to a user a particular scent, such as, for example the word "fresh" or a depiction of a flower. The transferable label 230 may further include indicia that are merely aesthetic or decorative in nature. Additionally, the indicia 270 may include one or more trademarks or other indicia that are typically associated with a particular type of wipes or manufacturer of wipes. The indicia 270 may be selected such that it describes a characteristic of wipes or type of wipes as well as being associated with a particular manufacturer or brand of wipes.

Often manufacturers of wet wipes market refillable containers, such as, for example a container according to the present invention. Manufacturers of such refillable containers typically prefer that consumers refill the container with the manufacturer's brand of wipes, which may be disposed in refill cartridges. However, because a competitor's refill cartridge may be configured such that the competitor's cartridge will fit in the manufacturer's container satisfactorily, a consumer may purchase the competitive product instead of the manufacturer's product. One way to increase the likelihood that a consumer will purchase the manufacturer's product may be to select indicia from a variety of popular children's icons, such as, for example cartoon characters. By depicting an incomplete icon, such as a cartoon character, a child may experience undesirable feelings because the character is incomplete. For example a child may experience confusion, sadness and/or distress when the child sees a cartoon character that is missing a head. Thus, the child's care provider may wish to alleviate such feelings by providing a container that does not have an incomplete depiction. One solution may be for the consumer just to leave the current label on the container. But since a consumer may not wish to purchase the same type of wipes repeatedly and/or because the fastener that joins the label to the wipes container may have a limited useful lifespan, it may be desirable to provide a refill cartridge that includes a label having indicia with both complementary and content-specific aspects. A consumer may be more likely to purchase a refill cartridge that will provide a complete depiction on the wipes container as well as describe the wipes or type of wipes disposed in the container, and thus may be more likely to purchase the manufacturer's refill cartridge.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning wipe product comprising:

a. a wipes cartridge including a plurality of cleaning wipes, the cleaning wipes cartridge being configured to fit into a cleaning wipes container such that at least one of the cleaning wipes is accessible by a user; and b. a transferable label joined to the wipes cartridge and being configured to form an opening in the cartridge when the transferable label is removed from the cartridge, the label having indicia depicting and/or describing a characteristic of a type of wipes included in the wipes cartridge, the transferable label including a fastener that enables a user to join the label to the cleaning wipes container, wherein the container includes indicia depicting an incomplete object and the indicia on the transferable label is complementary to the indicia on the container such that when the transferable label is joined to the container the indicia on the transferable label and the indicia on the container when viewed together depict a substantially complete object.

2. The cleaning wipe product of claim 1, wherein the incomplete object is an anthropomorphic object.

3. The cleaning wipe product of claim 1, wherein the transferable label is reattachably joined to at least a portion of the viewing area.

4. The cleaning wipe product of claim 1, wherein the transferable label is reattachably joined to at least a portion of the viewing area by a fastening means selected from the group consisting of magnets, electromagnets, hooks and loops, snaps, buttons, adhesives, cohesives, slots, grooves, electrostatic forces, and combinations thereof.

5. The cleaning wipe container of claim 1, wherein the indicia include words, numbers, letters, characters, symbols, shapes, colors, patterns, raised portions and/or combinations thereof.

6. The cleaning wipe container of claim 1, wherein the transferable label is joined to the wipes cartridge by a polymer film.

7. The cleaning wipe product of claim 1, wherein the opening enables a user to access at least one wipe in the cartridge.

8. The cleaning wipe product of claim 1, wherein the transferable label includes a removable backing material.

9. The cleaning wipe product of claim 1, wherein the transferable label is joined to the wipes cartridge by substantially the same fastener that enables a user to join the transferable label to the cleaning wipes container.

10. The cleaning wipe product of claim 1, further comprising packaging that substantially encloses the cartridge and transferable label.

11. The cleaning wipe product of claim 1, further comprising packaging wherein the transferable label is joined to the packaging.

12. The cleaning wipe product of claim 1, further comprising packaging wherein the transferable label being joined to the cartridge by the packaging.

* * * * *